US005255822A

United States Patent [19]

Mease et al.

[11] Patent Number: 5,255,822

[45] Date of Patent: Oct. 26, 1993

[54] AUTOMATIC SOAP DISPENSER

[75] Inventors: Richard B. Mease, Carpinteria; Robert E. Burridge, Arroyo Grande, both of Calif.

[73] Assignee: M & D International Enterprises, Inc., Carpinteria, Calif.

[21] Appl. No.: 981,408

[22] Filed: Nov. 25, 1992

Related U.S. Application Data

[62] Division of Ser. No. 803,543, Dec. 9, 1991, Pat. No. 5,186,360.

[51] Int. Cl.[5] ..... B67D 5/06

[52] U.S. Cl. ..... 222/63; 222/214; 222/212; 222/113

[58] Field of Search ..... 222/52, 63, 181, 207, 222/212, 214, 113

[56] References Cited

U.S. PATENT DOCUMENTS

| | | | |
|---|---|---|---|
| 3,327,901 | 6/1967 | Yerkovich | 222/52 |
| 4,722,372 | 2/1988 | Hoffman et al. | 222/52 X |
| 4,946,070 | 8/1990 | Albert et al. | 222/52 |
| 4,989,755 | 2/1991 | Shiav | 222/63 |
| 5,105,992 | 4/1992 | Fender et al. | 222/52 X |
| 5,186,360 | 2/1993 | Mease et al. | 222/63 |

*Primary Examiner*—Andres Kashnikow
*Assistant Examiner*—Kenneth Bomberg
*Attorney, Agent, or Firm*—John T. Matlago

[57] ABSTRACT

An automatically operated soap dispenser for use in washing the hands of a user is provided in a housing. Enclosed in an intermediate portion of the housing is a horizontally disposed transparent cylindrical chamber having an open front end and an opening in the upper wall thereof. Residing in the upper portion of the housing is a disposable liquid soap container having extending from the bottom thereof a resilient elongated tubular member with a self-sealing nipple valve on the lower end thereof which is positioned in the opening on the upper wall of the cylindrical chamber. A cyclically operated actuating means located in the housing above the cylindrical chamber is controlled to automatically squeeze the tubular member and supply a single quantity of liquid soap through the nipple valve in response to an upturned palm of a hand of the user being inserted into the open front of the cylindrical chamber.

11 Claims, 6 Drawing Sheets

| PRESET INPUT 4 | CLEAR INPUT 1 | OUTPUT 5 | |
|---|---|---|---|
| H | L | L | MOTOR M TURNED OFF |
| L | L | H | MOTOR M TURNED ON |

AUTOMATIC SOAP DISPENSER

This is a division of application Ser. No. 803,543 filed Dec. 9, 1991, now U.S. Pat. No. 5,186,360.

BACKGROUND OF THE INVENTION

This invention relates to an automatic soap dispenser for use in washing the hands of a user.

When equipment is provided in a public washroom for facilitating the washing of the hands, it is becoming more popular to mount a housing enclosing a soap dispenser on the wall adjacent the sink which enables a controlled quantity of soap to be delivered into the hand of a user. At the present time, the soap dispenser provided is usually of the type that requires the manual pressing of a bottom or lever to obtain a quantity of granulated or liquid soap. The manual handling of such a soap dispenser by a number of users spreads microorganisms and any dripping of soap from the dispenser creates an unsightly appearance.

SUMMARY OF THE INVENTION

In accordance with the present invention, a housing for enclosing an automatic soap dispenser includes a compartment on the upper portion thereof for storing a disposable plastic container of liquid soap. The plastic container has connected to the bottom thereof an elongated resilient outlet tubing provided with a rubber nipple valve. The nipple valve is provided with a self-sealing aperture formed by a pair of normally disposed intersecting slits cut through the bottom wall thereof. A fixed backwall is located within the housing immediately behind the outlet tubing. In order to automatically dispense the liquid soap, an actuating mechanism is enclosed within the housing which includes a squeezer member pivotally held by its upper end at a fixed point so as to be positioned in front of the outlet tubing. The squeezer member has attached on the rear thereof a pressure plate which is angularly disposed in its rest position such that only the upper corner edge thereof is adjacent the front wall of the outlet tubing. Provided within the housing on the rear of the outlet tubing is a motor having its shaft connected to engage a reducing gear train to provide a slower rotating output shaft which has keyed thereto the inner end of a crank. A pair of reciprocating connecting levers shaped to form a clevis have their adjacent rear ends pivotally connected to the outer end of the crank and their spaced apart front ends respectively pivotally connected to the lower ends of the sides of the squeezer member.

Just below the portion of the housing which encloses the actuating mechanism, the interior of the rear portion of the housing is formed to seat a transparent horizontally disposed cylindrical chamber having a rear wall and an open front end. When so seated, a substantial portion of the transparent sidewalls of the cylindrical chamber is exposed to view. The curved upper wall of the cylindrical chamber is provided with an opening to enable a portion of the nipple valve on the end of the outlet tubing to protrude down to the interior thereof. The central portion of the rear wall of the cylindrical chamber is provided with an opening in which an infrared sensor for the automatic soap dispenser is mounted. A removable segmental tray is formed so as to fit within the curved bottom wall portion of the cylindrical chamber. The upper surface of the segmental tray is formed with a circular well whose center is aligned with the vertical axis of the outlet tubing and, hence, the aperture of the nipple valve on the bottom end thereof.

A printed circuit card is vertically mounted within the housing such that its surface lies normal to the surface of the outer reciprocating connecting lever and adjacent the outlet tubing. The printed circuit card has a control circuit mounted on the surface thereof which includes a photocoupler mounted on the upper rear surface thereof. The photocoupler has a slot provided between emitter and detector elements thereof. A projecting member having its rear end attached on the outer reciprocating connecting lever has its front free end portion positioned in the slot when the actuating mechanism is in its rest position.

The housing enclosing the automatic soap dispenser is mounted on a wall adjacent a sink. When the upturned palm of a hand of the user is placed in the horizontally disposed chamber of the soap dispenser, the fingers of the hand are sensed by the infrared sensor on the interior rear wall thereof. This causes a signal to be provided on the output of the control circuit which energizes the motor of the actuating mechanism thereby causing it to slowly rotate the crank in, for example, a counterclockwise direction by means of the reducing gear train. As the motor rotates the crank, the pair of reciprocating connecting levers are moved rearwardly, thus pulling the free end portion of the projecting member out of the slot of the photocoupler. Moreover, the squeezer member is caused to be swung downwardly about its upper fixed pivot point so as to cause the upper corner edge of the canted pressure plate to initially pinch the wall of the outlet tubing against the rear fixed wall and then gradually compress the lower portion thereof against the rear fixed wall. This causes the pressure on the liquid soap filling the lower end portion of the outlet tubing to increase and forces the intersecting slits on the bottom wall of the nipple valve to open up to enable the liquid soap to be discharged through the open aperture so formed. After the motor has rotated the output shaft of the reducing gear train a half revolution, the continued rotation of the crank by the motor causes the reciprocating connecting levers to move forwardly to cause the squeezer member to swing upwardly about its upper fixed pivot point away from the front wall of the outlet tubing. This results in the pressure in the lower end portion thereof being relieved and the intersecting slits forming the aperture on the bottom wall of the nipple valve to return to their naturally unstressed or sealed position. As the pair of reciprocating connecting levers are returned to their rest position, the free end portion of the projecting member attached on the side of the outer connecting lever is again positioned such that it enters the slot on the back of the printed circuit card, thus blocking communication between the emitter and detector of the photocoupler mounted thereon. This terminating of the infrared beam of the emitter of the photocoupler from impinging on the detector thereof provides a clear signal to the control circuit causing it to provide a signal on the output thereof which deenergizes the motor when the squeezer member is again in its rest position. It should now be clear that the motor is energized to rotate the crank of the actuating mechanism for only one revolution or one cycle of operation in response to the hand of the user being sensed by the infrared sensor of the soap dispenser.

Accordingly, one of the objects of the present invention is to provide an actuating mechanism including a motor and reducing gear train for controlling a squeezer member, provided with a pressure plate on the rear thereof, to compress a resilient outlet tubing of a container of liquid soap so as to dispense a single dosage of liquid soap out of a self-sealing rubber nipple valve located on the end of the outlet tubing into the upturned palm of the hand of a user.

Another object is to provide an automatic soap dispender with a novel transparent horizontally disposed cylindrical chamber into the open front end of which the upturned palm of the hand of a user can be conveniently inserted and properly positioned to receive a dosage of liquid soap.

Another object of the present invention is to provide an automatic liquid soap dispenser with a horizontally disposed cylindrical chamber that includes a removable tray having a well located on the upper surface thereof for collecting any liquid soap which may inadvertently drip from the nipple valve.

With these and other objects in view, the invention consists of the construction, arrangement and combination of the various parts of the device, whereby the objects contemplated are attained as hereinafter set forth, pointed out in the appended claims and illustrated in the accompanying drawings.

DESCRIPTION OF THE PREFERRED EMBODIMENT

Figure 1:
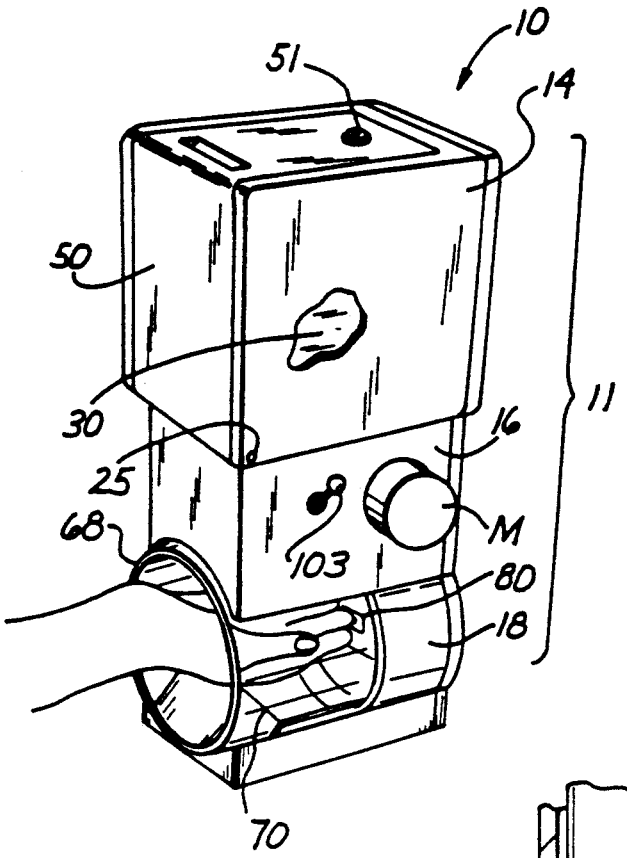
FIG. 1 is a perspective view showing the hand of a user positioned within the horizontally disposed transparent cylindrical chamber of the automatic soap dispenser enclosed within the housing therefor.
Figure 4:
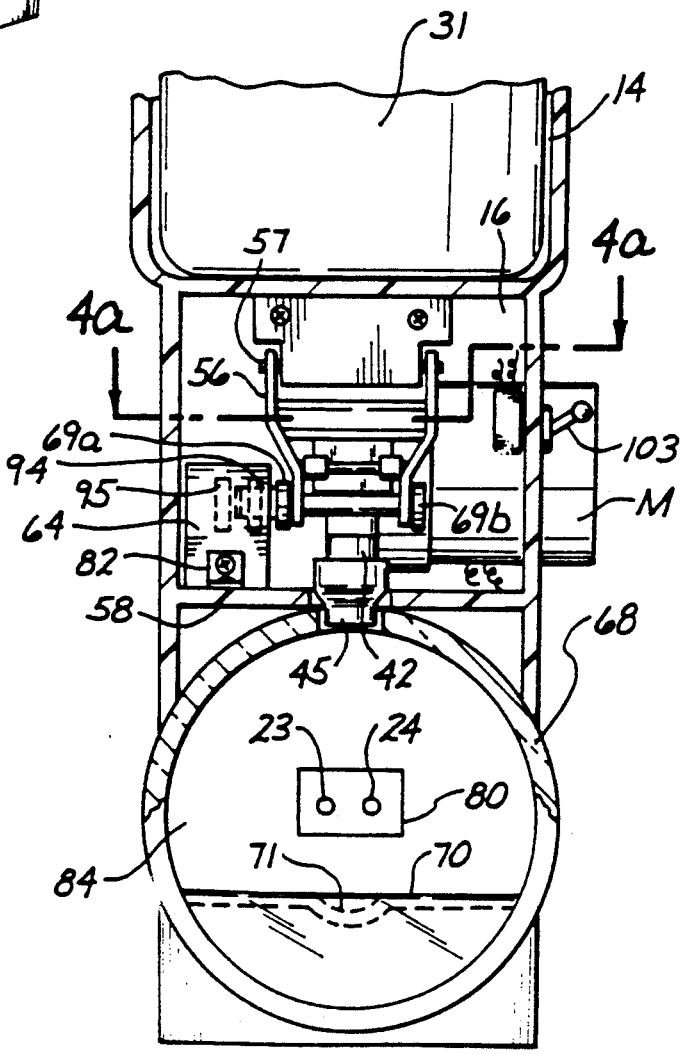
FIG. 4 is a vertical front sectional view of the intermediate portions of the housing showing the automatic soap dispenser as taken along line 4—4 of FIG. 2.

Referring to FIG. 1, a housing 10 encloses an automatic soap dispenser 11 in the upper portion 14, the intermediate portion 16 and the lower portion 18 thereof. The upper portion 14 of the housing for the automatic soap dispenser 11 is provided with an integral front and top cover 50 which is pivotally connected on the bottom front corners of the side walls thereof by side pins 25. Thus, the cover 50 can be swung open to enable a disposable container assembly 30 of liquid soap to be positioned therein. The intermediate portion 16 of the housing encloses an actuating mechanism, which includes a motor M, for dispensing the liquid soap from the container assembly 10. In the lower portion 18 of the housing, the front and middle side walls of the housing are opened up and formed to enable a horizontally disposed transparent cylindrical chamber 68 to be mounted therein.

The housing 10 is mounted for use on a wall adjacent a sink. As shown in FIG. 1, when the hand of the user is placed within the cylindrical chamber 68, the presence thereof is sensed by an infrared sensor 80 located on the rear internal wall of the cylindrical chamber. The output of sensor 80 the motor M of the actuating mechanism to enable a predetermined quantity of liquid soap in the container assembly 30 to be supplied into the upturned palm of the hand of the user. The user then withdraws the hand with the soap therein from the cylindrical chamber and washes both hands in the sink which is preferably provided with an automatically controlled faucet.

Figure 2:
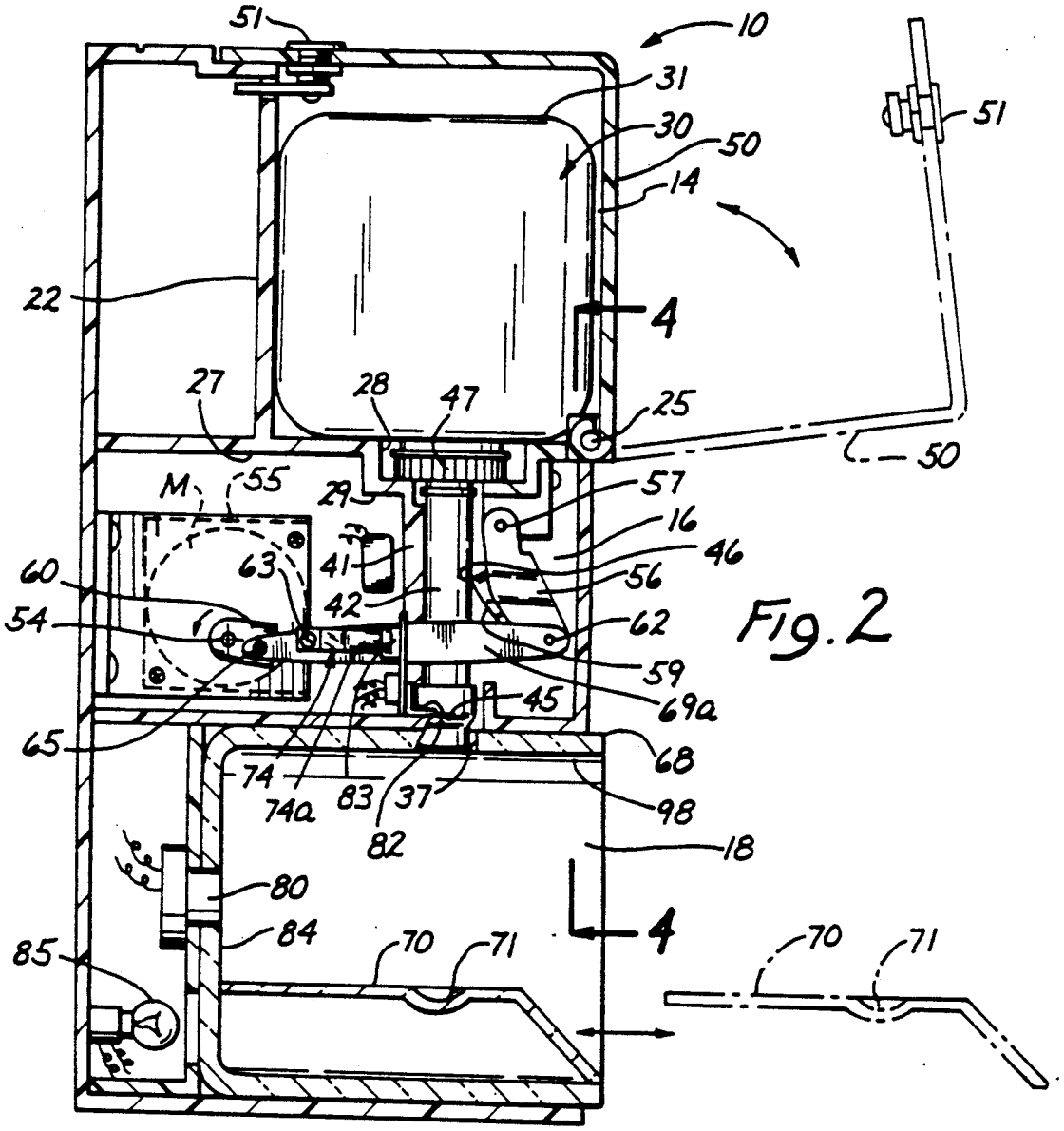
FIG. 2 is a side sectional view of the housing showing the automatic soap dispenser in the interior thereof.

Reference will next be made to FIG. 2 which is a sectional side view of the interior of the housing 10. The upper portion 14 of the housing forms a compartment with a vertical interior rear wall 22 and a bottom wall 27 having a circular opening 28 provided with a depressed bottom annular wall 29 that helps to support the disposable container assembly 30.

Figure 6:
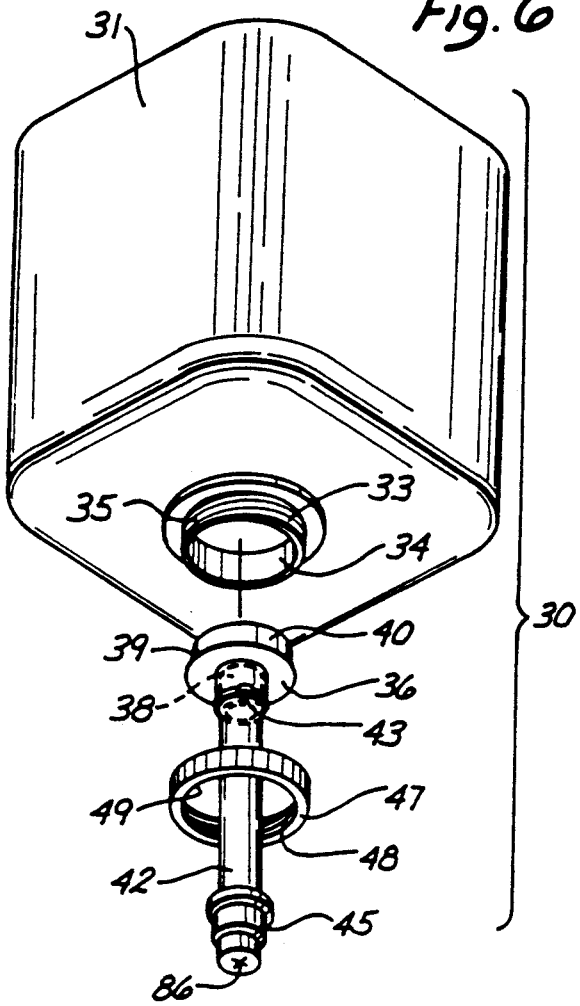
FIG. 6 is an exploded perspective view of the disposable liquid soap container and the outlet tubing with the self-sealing nipple valve on the bottom end thereof.

As shown in FIG. 6, the disposable assembly 30 includes a box-like plastic container 31, which may be made of a flexible plastic material, having on the bottom thereof an opening 34 provided with a rigid plastic neck 33. The neck 33 has threads 35 on the outer peripheral wall thereof. A circular insert 36 comprises an annular member formed with a short pipe 38 extending down from the bottom surface thereof and a short conical portion 40 extending upwardly from the top surface thereof so as to leave a peripheral lip 39 thereon. A length of resilient outlet tubing 42 has its upper end securely held on the short pipe 38 by a tie-band 43. A nipple valve 45 formed of a rubber material has the opening on its upper end securely attached on the bottom end of the outlet tubing 42. When the conical portion 40 of the circular insert 36 is inserted into the circular opening 34 of the neck 33, its peripheral lip 39 seats against the bottom edge of the neck 33. A retainer member 47 provided with internal threads 48 engages the external threads 35 on the neck 33, thereby holding and sealing the upper end of the outlet tubing 42 and the container 31 together.

Referring again to FIG. 2, in order to place the liquid soap container assembly 30 within the upper portion 14 of the housing, the integral front and top cover 50 of the housing is swung downwardly on its side pins 25, as shown by phantom lines. The resilient outlet tubing 42 of the liquid soap container assembly 30 is then inserted down through the central opening 28 on the bottom wall 27 of portion 14 of the housing such that the nipple valve on the lower end thereof extends down through portion 16 of the housing with the lower end of the nipple valve 45 extending into an opening 37 in the upper wall of a cylindrical chamber 68 located in the lower portion 18 of the housing.

Having placed the assembly 30 including the disposable container 31 of the liquid soap within the housing, the front and top cover 50 is then swung upwardly on its side pins 25 so that it is again seated in its closed position wherein it is locked by rotating the head 51 of a retaining means provided on the top of the housing.

Figure 3:
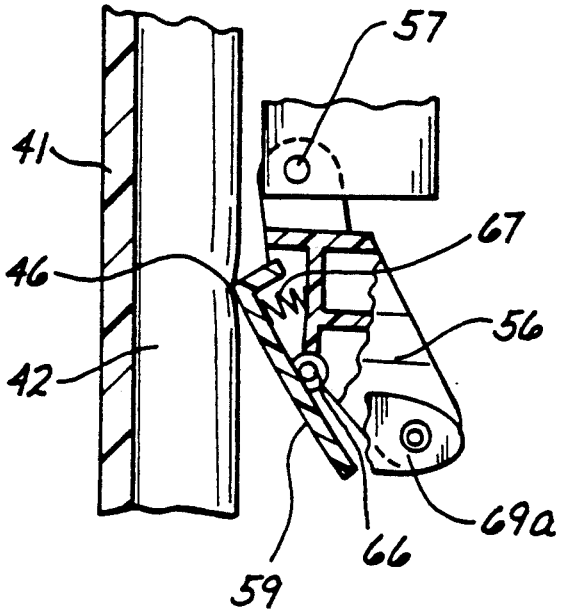
FIG. 3 is a side view of the squeezer member and pressure plate partly in cross section.
Figure 4A:
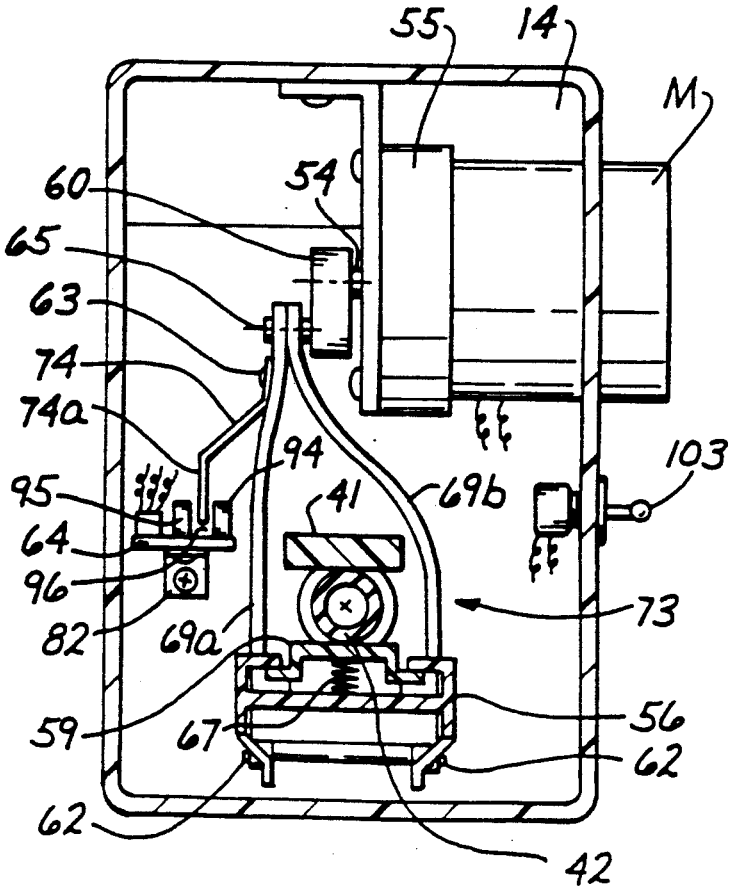
FIG. 4*a* is a top sectional plan view of the interior of the intermediate portion of the housing showing the automatic soap dispenser as taken along line 4*a*—4*a* of FIG. 4.

Referring next to FIGS. 2, 3, 4 and 4*a*, a motor driven actuating mechanism is located within the intermediate portion 16 of the housing. This mechanism includes a squeezer member 56 which has its upper end pivotally attached to a horizontally disposed rod 57 whose ends are held on internal sidewalls of the intermediate portion 16 so that the squeezer member 56 resides in front of the outlet tubing 42. As shown in FIG. 3, a pressure plate 59, having an upper rear corner edge 46, has the midpoint 66 of its length pivotally held on the back of the squeezer member 56. A compressive spring 67 on the upper back of the pressure plate 59 resiliently holds the corner edge 46 of the pressure plate up against the outlet tubing 42. Referring to FIG. 4*a*, which is a plan view of the interior of the intermediate portion 16 of the housing, taken along line 4*a*—4*a* of FIG. 4, the motor M, which may be an a.c. motor operating at 3400 rpm, is connected to drive a reducing gear train in a gear box 55 provided with an output shaft 54 rotating at 1 rps. A crank 60 has the inner end thereof keyed to gear output shaft 54 and the outer end thereof pivotally connected by pin 65 to the rear ends of a pair of connecting levers 69*a* and 69*b* forming a clevis 73. As shown in FIG. 4*a*, the squeezer member 56 located on the front of the outlet tubing 42 has the bottom sides thereof respectively pivotally connected by pins 62 to the spaced front ends of the connecting levers 69*a* and 69*b*. The outer connecting lever 69*a* located on the side of the housing away from the motor M and gear box 55 has a projecting member 74 attached near the crank end thereof. The projecting member 74 is bent such that its free end portion 74*a* is spaced from and lies parallel to the front end portion of the outer connecting lever 69*a*. A printed circuit card 64 having a control integrated circuit 130 on the surface thereof is mounted on the bottom wall 58 of housing section 16 by a corner bracket 82 such that circuit card 64 is vertically disposed with its surface normal to the front end portion of connecting lever 69*a*. A photocoupler 83 comprised of an infrared emitter 94 in the form of a photodiode CR4 and a detector 95 in the form of a reverse photodiode CR5 are mounted on the upper rear surface of the printed circuit card 64 so as to be spaced from each other to provide a slot 96. When the squeezer member 56 is in its rest position, as shown in FIG. 2, with the upper rear corner edge 46 of its pressure plate 59 resiliently lightly held adjacent the wall of tubular outlet 42, and with the crank 60 in its substantially forwardmost position, the projecting member 74 attached on the connecting lever 69*a* has its free end portion 74*a* extending into the slot 96 so as to prevent the infrared beam of the emitter 94 from impinging on the detector 95 of the photocoupler 83. As a result, detector 95 is not conducting and a low voltage level provided on the output thereof serves to operate through the power integrated circuit 130 of FIG. 9 to deenergize the motor M1.

It should now be understood that when the infrared sensor 80 of the soap dispenser 11 senses a hand in the cylindrical chamber 68, a low voltage level signal is provided to preset input 4 of the control integrated circuit 130 (FIG. 9) which, as described infra, provides a high voltage level signal on the output 5 thereof to energize the motor M.

As the motor M starts to rotate the crank 60, the connecting lever 69*a* is moved rearwardly, thus withdrawing the free end portion 74*a* of the projecting member 74 out of the slot 96 of the photocoupler 83. However, the resulting high voltage level provided on the output of the detector 95 when applied on the clear input 1 of the integrated circuit 130 does not affect the output 5 thereof and the motor M continues to rotate.

Figures 5, 10:
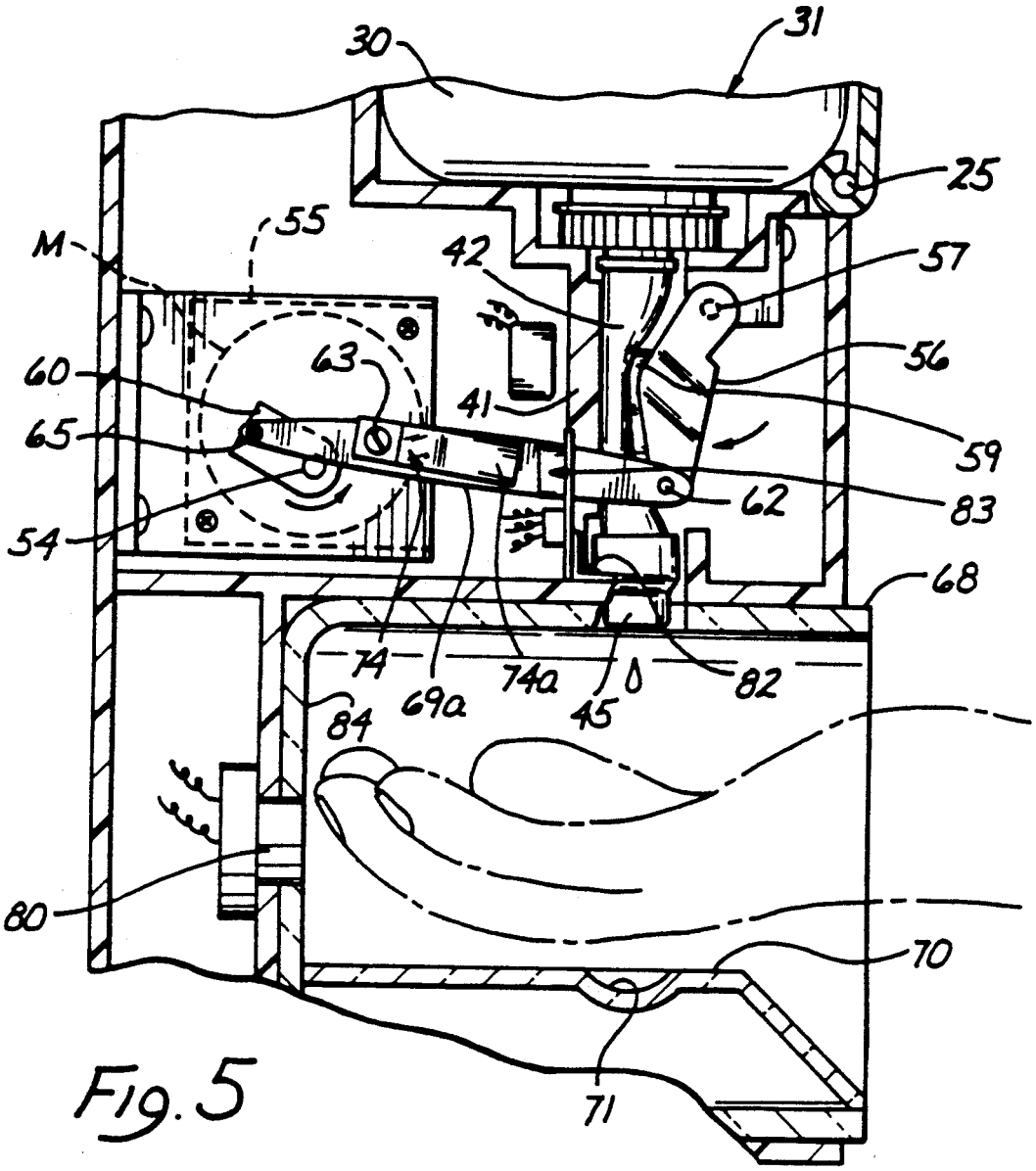
FIG. 5 is a partial side sectional view of the interior portion of the housing showing the squeezer member of the automatic soap dispenser in its operating position of squeezing the outlet tubing in response to the hand of a user being inserted into the cylindrical chamber thereof.
FIG. 10 is a truth table depicting the logic operation of the control integrated circuit.

As shown in FIG. 5, after the crank 60 has been rotated a half revolution causing the pressure plate 59 on the squeezer member 56 to squeeze the outlet tubing 42 and cause a predetermined amount of liquid soap to be supplied by the nipple valve 45 into the palm of the hand of the user, the continued rotation of the crank 60 by the motor M returns the connecting levers 69*a* and 69*b*, and thereby the squeezer member 56, back to their rest position (FIG. 2). Thus, the free end portion 74*a* of the arm 74 attached on the side of the outer connecting lever 69*a* returns to again extend into the slot 96 on the photocoupler 83 on the back of the printed circuit card 64, as shown in FIG. 4*a*. As a result of this action, the output of the detector 95 of the photocoupler 83 again has a low voltage level thereon which when applied to the clear input 1 of the integrated circuit 130 (FIG. 9) causes the motor M to be deenergized and the crank 60 to discontinue rotating after one revolution or cycle of operation.

Next to be described in FIG. 2, is the lower portion 18 of the housing located beneath the intermediate portion 16 thereof wherein the horizontally disposed cylindrical chamber 68 of the soap dispenser is fitted to reside. The cylindrical chamber 68 is formed of a transparent plastic material. The circular opening 98 on the front of the cylindrical chamber 68 is adapted to receive a removable segmental plastic tray 70 which fits within the internal bottom surface of the cylindrical chamber 68. This segmental tray 70 is provided on its upper surface with a small circular well 71 located with its center vertically aligned opposite the aperture 86 on the end of the nipple valve 45.

It should be especially noted that the space left in the cylindrical chamber 68 after the segmental tray 70 is inserted in the bottom thereof is just large enough to conveniently receive the upturned palm of the hand of the user without the need for contacting the interior walls of the cylindrical chamber. Moreover, the cylindrical chamber 68 is made just deep enough to enable the fingers of the hand to be properly positioned therein to be sensed by the infrared sensor 80 on the rear wall of the cylindrical chamber while the palm of the hand is located below the outlet valve 45.

It should be further noted that a light bulb 85 is positioned to illuminate the rear wall of the transparent cylindrical chamber 69 thereby enabling it to function as a light pipe so as to light up the transparent sidewalls of the cylindrical chamber.

Figure 7A:
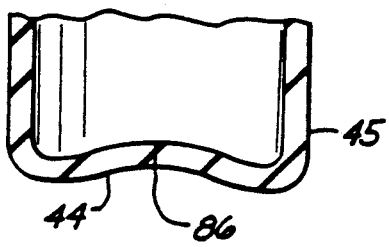
FIG. 7*a* is a vertical sectional view of the self-sealing nipple valve showing the aperture on the bottom wall thereof in its closed position as taken along line 7*a*—7*a* of FIG. 7.
Figure 7:
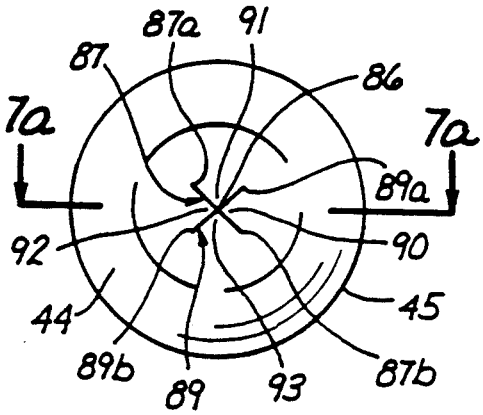
FIG. 7 is a bottom view of the self-sealing nipple valve showing the aperture on the bottom wall thereof in its closed position.

Reference will next be made to FIGS. 7, 7*a*, 8 and 8*a* which show details of the nipple valve 45 attached to the bottom end of the outlet tubing 42. It should be noted that the outlet tubing 42 and the outlet valve 45 are preferably made of a rubber material used for surgical tubing. Moreover, although they are shown as being made as separate parts they may be formed as a single part. As shown in FIG. 7, which is a view of the bottom wall 44 of the nipple valve 45, a pair of intersecting slits 87 and 89, that are disposed perpendicular to each other and intersect at their midpoints, are cut through the center of the concave bottom wall 44 thereof. FIG. 7*a* is a vertical sectional view of the nipple valve 45 as taken along line 7*a*—7*a* of FIG. 7. The point 86 on the bottom of the nipple valve 45 where the midpoints of the slits 87 and 89 cross corresponds to the aperture 86 of the nipple valve when it is closed, i.e., when the interior of the nipple valve 45 is not under pressure. As noted in FIG. 7, 87*a*and 87*b* correspond to opposite ends of the slit 87, and 89*a* and 89*b* correspond to opposite ends of the slit 89. Further, 91 corresponds to the inner corner of a triangular portion formed between slit ends 87*a* and 89*a*; 90 corresponds to the inner corner of a triangular portion formed between the slit ends 89*a* and 87*b*; 93 corresponds to the inner corner of a triangular portion formed between the slit ends 87*b* and 89*b*; and 92 corresponds to the inner corner of a triangular portion formed between the slit ends 89*b* and 87*a*.

Figure 8:
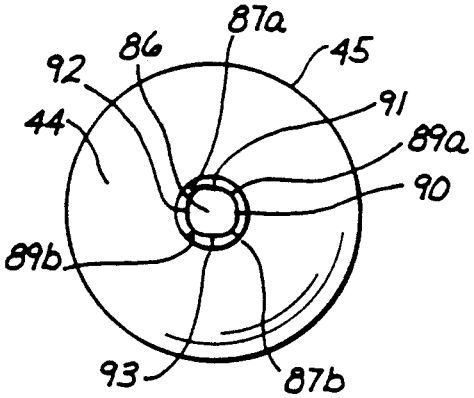
FIG. 8 is a bottom view of the self-sealing nipple valve showing the aperture on the bottom wall therof in its open position.

When the motor M initially rotates the gear train in the gear box 55, and hence the crank 60, the squeezer member 56 is pivoted about its upper pivot point 57 from its rest position such that the upper corner edge 46 of the pressure plate 59 initially pinches a point on the front wall of the outlet tubing 42 against the fixed rear wall 41. Continued rotation of the crank 60 then gradually compresses the front wall portion of the outlet tubing 42 below that point against the fixed rear wall 41, resulting in the pressure on the liquid soap within the outlet tubing 42 increasing such that it causes the inner corners 90, 91,,92 and 93 of the resilient triangular portions formed between the adjacent ends of slits 87 and 89 to be pushed axially and radially outwardly, i.e., causes the aperture 86 to be opened up, as shown in FIGS. 8 and 8*a*.

Figure 8A:
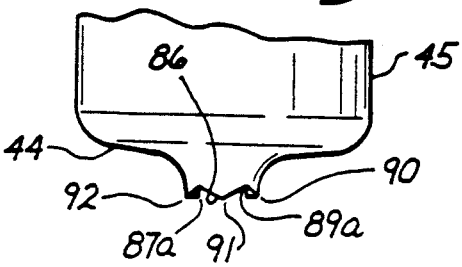
FIG. 8*a* is a side view of the lower end portion of the self-sealing nipple valve showing the aperture on the bottom wall thereof in its open position.

Thus, as shown in FIG. 8*a*, when the aperture 86 on the bottom wall of the outlet valve 45 opens, the inner corners 90, 91 and 92 and 93 of the respective triangular portions become the peaks of the resulting sawtooth structure forming the open aperture 86 and the ends 87*b*, 89*a*, 87*a* and 89*b* of the slits 87 and 89 become the low points of the sawtooth structure formed on the end of the open aperture 86.

As a result, when the triangular portions which form aperture 86 open up due to the pressure build up within the nipple valve 45, the elastic stress created in the rubber material of which the nipple valve 45 is made is removed when the internal pressure is no longer present because the lower portion of the outlet tubing 42 is no longer being compressed against the rear wall 41. As a result, the triangular portions which form the aperture 86 immediately return to their naturally unstressed initial contiguous position wherein the aperture 86 is again tightly sealed.

It should be noted that the sealing of the aperture 86 when it closes as a result of the outlet tubing 42 returning to its natural open unstressed shape results in a vacuum being formed in the lower portion thereof which draws another load of liquid soap from the container 31 to again fill the lower portion of the outlet tubing 42 including the nipple valve 45.

Figure 9:
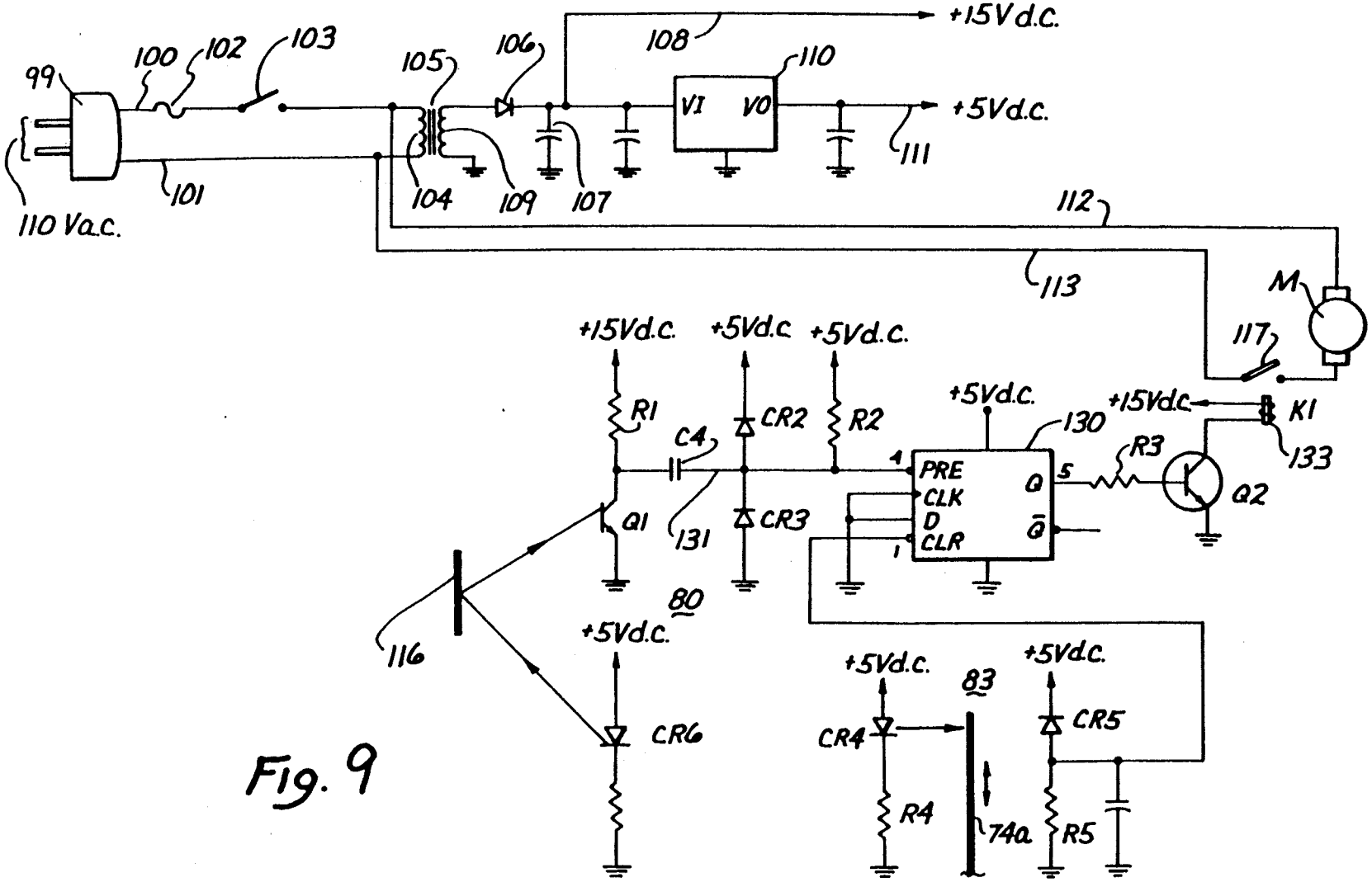
FIG. 9 is a schematic diagram of the electrical circuit provided for automatically operating the unit of the present invention.

Reference will next be made to FIG. 9 which shows a schematic wiring diagram of an electrical circuit for controlling the operation of the automatic soap dispenser 11.

A plug 99 for connecting to a 110 alternating current supply includes a line 100, having a fuse 102 and an on-off switch 103 therein, and a line 101. These lines are connected across a primary winding 104 of a step-down transformer 105. The secondary winding 109 of the transformer is connected by way of a diode 106 and a grounded capacitor 107 to provide a +15 volt d.c. on an output line 108. This +15 volt d.c. is also connected to the V1 input of a converter integrated circuit 110 which may be a 78L05 integrated circuit that provides a +5 volt d.c. on an output line 111.

The line 100 from the plug 99 is connected by a load 112 to one terminal of the motor M of the automatic soap dispenser 11 and the other line 101 from the plug 99 is connected by a lead 113 to a normally open spring-biased contact 117 of a relay K1 which connects line 101 to the other terminal of the motor M.

Next to be noted is that the electrical control for the motor M of the soap dispenser 11 is provided by control integrated circuit 130 that may be in the form of a modified D flip-flop which may be a 74HC74. The control integrated circuit 130 is provided with a preset input 4, an output 5 and a clear input 1. The sensor 80 for the liquid soap dispenser includes infrared emitter 23 which may be a light emitting diode CR6 and infrared detector 24 which may be a phototransistor Q1 whose collector is connected through a resistor R1 to +15 volts d.c. A lead 131 with a capacitor C4 therein couples the collector of the phototransistor Q1 to the preset input 4 of the integrated circuit 130. The preset input 4 is also clamped at 5 volts d.c. by diodes CR2 and CR3 and current for charging capacitor C4 is supplied by a resistor R2 connected to +5 volts d.c. As will be further discussed, infra, the capacitor C4 is selected to have a time constant which enables it to be charged from the low voltage level, namely ground, to the high voltage level, namely +5 volts, by current supplied through the resistor R2 in the time it takes for the crank 60 to rotate one cycle. The output 5 of the control integrated circuit 130 is connected by a resistor R3 to the base of a transistor Q2 whose collector is connected by a solenoid winding 133 of relay K1 to +15 volts d.c. The emitter of transistor Q2 is grounded.

The photocoupler 83 includes emitter 94 in the form of a light emitting diode CR4 and detector 95 in the form of a photodiode CR5. The light emitting diode CR4 has its cathode connected to ground by a resistor R4 and its anode connected to +5 volts d.c. The photodiode CR5 includes a reverse diode CR5 having its cathode connected to +5 volts d.c. and ita anode connected by a resistor R5 to ground.

When the on-off switch 103 on the sidewall of the unit is initially closed, to supply power to the unit, the light bulb 85 (FIG. 2) located behind the transparent cylindrical chamber 68 is turned on so as to light up the exposed transparent sidewalls of the cylindrical chamber 68. Moreover, because the movable contact 117 of relay K1 is normally spring-biased open, the motor M of the automatic soap dispenser is deenergized.

The emitter CR6 of the soap dispenser sensor 80, and the emitter CR4 of photocoupler 83, are both continually energized once the on-off switch 103 is turned on. However, the detector Q1 of the soap dispenser sensor 80 and the detector CR5 of the photocoupler 83 are both turned off when the on-off switch 103 is initially closed since their operation is dependent on receiving a portion of the infrared beam from their respective emitters which only occurs during the operation of the apparatus by the user.

OPERATION

The operation of the automatic soap dispenser will next be described by referring to FIG. 2 which shows the actuating means therefor in its rest position with the squeezer member 56 just in front of the outlet tubing 42 with the upper corner edge 46 of the pressure plate 59 on the rear thereof resiliently contacting the rear surface of the outlet tubing 42. Moreover, as shown in FIG. 4*a*, when in the rest position, the free end portion 74*a* of the projecting member 74 attached to the side of the connecting lever 69*a* is positioned to extend into the slot 96 between the emitter CR4 and the detector CR5 of the photocoupler 83. Further, by referring to FIG. 9, when in the rest position, the control integrated circuit 130 on the printed circuit card 64, has the high level voltage of 5 volts d.c. on the preset input 4, the low voltage level of ground on its output 5, and the low voltage level of ground on its clear input 1. The high voltage level of 5 volts d.c. on preset input 4 is obtained by clamping capacitor C4 to 5 volts d.c. by use of clamping diodes CR2 and CR3.

Now then, when a hand is placed within the cylindrical chamber 68 to receive a dosage of liquid soap, a portion of the infrared beam from the emitter CR6 of the soap dispenser sensor 80 is reflected off the hand, schematically indicated by 116 in FIG. 9, onto the phototransistor Q1 so as to cause it to conduct. Once the phototransistor Q1 of the soap dispenser sensor 80 conducts, the drop in voltage across the resistor R1 in the collector thereof lowers the voltage level on the capacitor C4 to ground. This creates a low voltage level of ground on the preset input 4 of the control integrated circuit 130 which, together with the low voltage level on the clear input 1, see FIG. 10, switches the voltage level on the output 5 thereof from the low voltage level to the high voltage level. This high voltage level on output 5 turns on the transistor Q2 causing the solenoid winding 133 of relay K1 to conduct and thereby close the spring-biased contact 117 so as to connect lead 113 to energize motor M. Once the motor M starts to rotate the output shaft 54 of the gear train, (FIG. 4*a*), the crank 60 starts to rotate, for example, in a counterclockwise direction (FIG. 2). This pulls back the connecting levers 69*a* and 69*b* and, therefore, swings the squeezer member 56 down about its upper pivot point 57 such that the upper rear corner edge 46 of the pressure plate 59 on the back of the squeezer member 56 first pinches a point on the outlet tubing wall 42 against the rear wall 41, and then the remaining surface of the pressure plate 59 gradually presses the lower portion of the outlet tubing 42 so as to increase the pressure on the liquid soap confined within the bottom portion thereof and including the outlet valve 45. This causes the intersecting slits 87 and 89 (FIG. 6) forming the aperture 86 on the bottom wall of the outlet valve 45 to open up to expel a predetermined quantity of liquid soap, as shown in FIG. 5.

Note that as the crank 60 started to rotate and pull the connecting levers 69*a* and 69*b* rearwardly, it also drew the free end portion 74*a* of the arm 74 attached on the side of connecting lever 69*a* out of the slot 96 (FIG. 4*a*) between the emitter CR4 and detector CR5 of the photocoupler 83 mounted on the rear of the printed circuit card 64. The resulting conduction of the detector CR5 of the photocoupler 83 from +5 volts d.c. through the resistor R5 raises the low voltage level on the output of detector CR5 to a high voltage level which is applied to the clear input 1 of the control integrated circuit 130. The change, at this time, to a high voltage level on clear input 1, however, does not affect the high voltage level on output 5 of the control integrated circuit 130 and so the motor M continues to operate.

As noted in FIG. 5, once the liquid soap has been expelled from the container 30, as the crank 60 continues to be rotating by the output shaft 54 of the gear box 55, it now reverses the direction of movement of the connecting levers 69*a* and 69*b* so as to push the squeezer member 56, with the pressure plate 64 on the back surface thereof, about its fixed pivot 57 away from the outlet tubing 42 so as to enable the latter to return to its natural open position. This reduces the pressure on the liquid soap within the outlet valve 45 causing the intersecting slits 87 and 89 on the bottom thereof to again return to their unstressed contiguous positions wherein they close off the aperture 86, as shown in FIG. 7.

At this time, the movement of the connecting levers 69*a* and 69*b* back to their rest position causes the free end portion 74*a* of the projecting member 74 attached to the side of the outer connecting lever 69*a* to again enter the slot 96 of the photocoupler 83 mounted on the back of the circuit card 64 so as to cut off the infrared beam from the emitter CR4 to the detector CR5 of the photocoupler 83. This results in the output of the detector CR5 of the photocoupler 83 now again having the low level voltage thereon.

Simultaneously with the energizing of the motor M to start the cycle of operation of the crank 60,, the capacitor C4 which is now at the low voltage level starts to be charged to the high voltage level by current being supplied by resistor R2. Since, the time constant of capacitor C4 is selected to charge the preset input 4 to the high voltage level slightly before the end of the cycle of the crank 60, the preset input 4 is at a high voltage level at the end of the cycle at the same time that the clear input 1 is at a low voltage level (see FIG. 10) which serves to clear, i.e., switch the high voltage level on the output 5 thereof to the low voltage level. This low voltage level when applied on the base input of the transistor Q2 terminates the conduction of current through the solenoid winding 133 of the relay K1 and thereby opens the spring-biased contact 117 thereof which deenergizes the motor M and, therefore, stops it and the crank from further rotating.

It should be understood that output shaft 54 of the gear train, and, hence, crank 60 is made to rotate at one cycle per second. That is, the squeezer member 54 moves through only one cycle of operation to expel a single quantity or dosage of soap onto the upturned palm of the hand of the user each time the hand is positioned in the cylindrical chamber 68. Thus, in order to stop the motor M at the end of a single cycle of operation, it is necessary for either the hand of the user to be pulled out of the cylindrical chamber 68 or for the circuit to otherwise provide for the preset input 4 to be at the high voltage level at the end of a single cycle of operation. This is because it is necessary, as shown by the truth table in FIG. 10, for the preset input 4 to be at the high voltage level at the end of a single cycle of operation simultaneously with the clear input 1 being at the low voltage level in order for the output 5 to be switched to a low voltage level so as to stop the motor M at the end of a single cycle of operation.

Since the user of the unit is likely to keep his hand in the cylindrical chamber 68 longer than 1 second, it is for this reason that the present circuit provides for the selecting of a capacitor C4 with a time constant that will enable it to be charged to the high voltage level in slightly less than 1 second, that is, one cycle of crank 60. This assures that the motor M will be stopped after a single cycle of operation of the soap dispenser, even if the user leaves his hand in the cylindrical chamber 68 for a longer period of time than 1 second. It should be evident that if the motor M were to continue to operate for more than 1 cycle when a hand is placed in the chamber, then undesired additional dosages of liquid soap would be expelled onto the palm of the hand of the user.

Now then, after the user has withdrawn his hand with the soap thereon out of the cylindrical chamber 68, he washes his soapy hands in the sink, preferably provided with an automatic control for the water faucet.

While the description has been concerned with a particular structural embodiment of the invention, it is to be understood that many modifications, and variations may be made, both in the structure and operation of the exemplary embodiment herein, without departing from the spirit of the invention. Therefore, the present invention is to be considered as including all possible modifications, and variations thereof coming within the scope of the invention as defined in the appended claims.

What is claimed is:

1. An automatic soap dispenser comprising:

a horizontally disposed chamber having an open front end, a rear wall, sidewalls, and an upper wall with an opening therein:

a sensor on the rear wall of said chamber;

a container of liquid soap including a resilient tubular member having an outlet valve on an end portion thereof and connected at its other end to the interior of the container, said outlet valve positioned adjacent the opening in the upper wall of the chamber;

motor means for rotating a crank having a free end;

squeezer means pivotally mounted in front of the tubular member so as to have a free end;

connecting lever means for pivotally connecting the free end of the squeezer means to the free end of said crank; and circuit means responsive to said sensor when a hand is placed in said chamber to energize said motor means to rotate said crank and thereby move said connecting lever means to cause said squeezer means to move from a rest position of press said tubular member to expel a quantity of liquid soap through the outlet valve into the palm of the hand of the user, said connecting lever means upon returning said squeezer means to its rest position providing a signal to deenergize said motor means.

2. An automatic soap dispenser as defined in claim 1 wherein said outlet valve is formed of a rubber material.

3. An automatic soap dispenser as defined in claim 1 wherein said outlet valve has a bottom surface provided with a self-sealing aperture formed by a pair of intersecting slits which open up to expel liquid soap when the tubular member filled with liquid soap is pressed by the squeezer means and then close when the squeezer means returns to its rest position.

4. An automatic soap dispenser as defined in claim 1 wherein a photocoupler comprised of a.ı emitter and detector having a slot therebetween is mounted adjacent said connecting lever means, and wherein said connecting lever means includes a projecting member with a free end portion, whereby upon the free end portion of the projecting member entering said slot upon said connecting means returning said squeezer means to its rest position, the signal is provided to deenergize said motor means.

5. An automatic soap dispenser as defined in claim 1 wherein said chamber has a bottom wall and including a removable drip tray adapted to be positioned on the bottom wall of said chamber, said tray having a well located on its surface so as to be vertically aligned with the outlet valve on the tubular member.

6. An automatic soap dispenser as defined in claim 1 wherein the sidewalls of said chamber are formed of a transparent material.

7. An automatic soap dispenser as defined in claim 6 wherein a light source is positioned adjacent said chamber to light up the transparent sidewalls therof.

8. A soap dispenser as defined in claim 1 wherein said motor means includes an a.c. motor operating at 3400 revolutions per minute and a reducing gear train driven by said a.c. motor for rotating said crank at 1 revolution per second.

9. In a housing for an automatic soap dispenser, a container for liquid soap;

a resilient tube having a self-sealing resilient nipple valve on an end portion thereof and having its other end connected to the interior of said container;

a back-up wall located in the housing behind the tube;

a squeezer means having its upper end pivotally connected to the housing so as to have a free bottom end;

a motor means having an output shaft;

a crank having its inner end keyed on the end of said output shaft so as to have a free outer end;

connecting lever means pivotally connected between the bottom free end of said squeezer means and the free outer end of said crank; and a horizontally disposed chamber in said housing having an open front end and a top wall with an opening therein aligned with the nipple valve;

whereby when said motor means is energized to rotate the crank it causes the squeezer means to move from a rest position to press said resilient tube against the back-up wall to expel a quantity of liquid soap from within the tube through the nipple valve onto the palm of the hand of a user placed in the chamber.

10. In a housing for an automatic soap dispenser as claimed in claim 9 wherein said self-sealing resilient nipple valve comprises:

a concave wall on the bottom of the resilient tube;

a pair of equal length slits cut in the bottom wall such that they lie perpendicular to each other and cross at their midpoints to define an aperture;

each said slit forming opposing walls that are contiguous to each other when the resilient tube is not being squeezed thereby closing the aperture;

whereby when the ;resilient tube filled with liquid soap is squeezed, the opposing walls of the slits are opened up radially and axially thereby opening the aperture to expel the liquid soap from the resilient tube.

11. An automatic soap dispenser, as claimed in claim 1 wherein said circuit means comprises:

an integrated circuit having a preset input, a clear input and an output;

said integrated circuit when the squeezer means is in a rest position having a high voltage level on its preset input, a low voltage level on its output and a low voltage level on its clear input;

a photocoupler including an emitter and a detector having a slot therebetween mounted adjacent the connecting lever means;

a projecting member with a free end portion attached on the side of the connecting lever means such that its free end portion resides in the slot when the squeezer means is in its rest position;

said sensor coupled to the preset input by a capacitor selected to have a time constant which raises a low voltage level on the preset input to a high voltage level by way of a resistor connected to a source of high level voltage in slightly less than one cycle of the crank; and said sensor responsive to a hand of a user positioned below the outlet valve to provide a low voltage level on the coupling capacitor and therefore the preset input of the integrated circuit which together with the low voltage level on the clear input thereof switches the output thereof to a high voltage level which provides for energizing said motor means to rotate the crank and move said connecting lever means to pull said squeezer means from a rest position into an operating position where it expels a quantity of liquid soap from the outlet valve into the palm of the hand of the user, the crank upon continuing to rotate providing for returning the connecting lever means and pushing the squeezer means back to the rest position in which the free end portion of said projecting member again extends into the slot of the photocoupler and provides a low voltage level on the clear input of the integrated circuit which together with the high voltage level on the preset input thereof causes the output thereof to switch to a low level voltage which deenergizes the motor means.

* * * * *